US007862012B2

(12) United States Patent
Chang

(10) Patent No.: US 7,862,012 B2
(45) Date of Patent: Jan. 4, 2011

(54) CARBURETOR OF A REMOTE CONTROL MODEL

(75) Inventor: Lien Sheng Chang, Taichung Shien (TW)

(73) Assignee: Golden Lion Enterprise Co., Ltd., Taichung Shien (TW)

( * ) Notice: Subject to any disclaimer, the term of this patent is extended or adjusted under 35 U.S.C. 154(b) by 792 days.

(21) Appl. No.: 11/849,316

(22) Filed: Sep. 3, 2007

(65) Prior Publication Data

US 2009/0057930 A1 Mar. 5, 2009

(51) Int. Cl.
*F02M 9/06* (2006.01)

(52) U.S. Cl. ..... 261/44.6; 261/44.8; 261/62; 261/66; 261/DIG. 38

(58) Field of Classification Search ..... 261/44.6, 261/44.8, 62, 66, DIG. 23, DIG. 24, DIG. 38, 261/DIG. 39

See application file for complete search history.

(56) References Cited

U.S. PATENT DOCUMENTS 1,239,173 A * 9/1917 Gaveler ..... 261/44.6
1,742,429 A * 1/1930 Walker ..... 261/44.8
2,630,304 A * 3/1953 Rivoche ..... 261/44.8
2,995,349 A * 8/1961 Kennedy, Sr. ..... 261/41.1
3,291,464 A * 12/1966 Hammerschmidt et al. . 261/142
4,783,286 A * 11/1988 Lee ..... 261/23.2
5,599,484 A * 2/1997 Tobinai ..... 261/44.2
6,827,337 B2 * 12/2004 Terakado ..... 261/44.3
7,427,056 B2 * 9/2008 Ohashi et al. ..... 261/44.6
2004/0251565 A1 * 12/2004 Douyama et al. ..... 261/44.3
2005/0104235 A1 * 5/2005 Sasaki et al. ..... 261/44.6

FOREIGN PATENT DOCUMENTS

JP 64-69766 A * 3/1989 ..... 261/44.8

* cited by examiner

*Primary Examiner*—Richard L Chiesa
(74) *Attorney, Agent, or Firm*—Ming Chow; Sinorica, LLC

(57) ABSTRACT

A carburetor of a remote control model has a main body axially bored with an axial hole that is installed with a throttle and a second needle in its one side and provided with a female-threaded section formed at a certain portion of its other side for engaging with a male-threaded section of an adjustment valve. The adjustment valve possesses a fuel entering passage formed axially with a dead end, and an injection nozzle formed at the end corresponding to and for a needle valve of the second needle to move to and fro therein. And, the adjustment valve is directly installed in the axial hole without being accompanied with other components, effective to lower progressive tolerance between the injection nozzle and the needle valve to provide uniform fuel injection.

6 Claims, 7 Drawing Sheets

CARBURETOR OF A REMOTE CONTROL MODEL

BACKGROUND OF THE INVENTION

1. Field of the Invention

This invention relates to an engine of a remote control model, particularly to an improvement of its carburetor.

2. Description of the Prior Art

As shown in FIGS. 1 and 2, a conventional carburetor body 10 is provided with an axial hole 11 bored axially, a throttle 12 installed movably in one side of the axial hole 11, and a guiding sleeve 14 installed in the other side of the axial hole 11. The throttle 12 is provided with a throttle hole 121 that is screwed with a second needle 13. The guiding sleeve 14 is screwed with a third needle 15 provided with an injection nozzle 151 corresponding to a needle valve 131 provided in the second needle 13. There is a threaded hole 141 bored vertically throughout the guiding sleeve 14 and the carburetor 10 for being fixedly engaged with a main needle 16, which is provided with a fuel inlet nozzle 161 located aside to let fuel pass through to be jetted out from the injection nozzle 151.

However, with the throttle 12 and the second needle 13 installed in one side of the axial hole 11, and the guiding sleeve 14 and the third needle 15 installed in the other side, there are three sets of progressive tolerance possibly happening at two sides of the axial hole 11 respectively while assembling owing to too many components closely assembled together, apt to downgrade precision. As shown in FIG. 3, during the assembly of the components mentioned above, there are relatively at least six sets of progressive tolerance created to keep center lines L and L1 that should be aligned between the needle valve 131 and the injection nozzle 151 deviated. Thus, the gap between the needle valve 131 and the injection nozzle 151 may become unsmooth to cause an uneven fuel injection, affecting fuel control. In addition, an end 152 of the third needle 15 is extended into a mixing chamber 17, which is formed between the throttle 12 and the guiding sleeve 14 to let fuel and air to mix up, to reduce the space of the mixing chamber 17.

SUMMARY OF THE INVENTION

The objective of this invention is to offer a carburetor of a remote control model.

The carburetor has a main body axially bored with an axial hole that is installed with a throttle and a second needle in its one side and provided with a female-threaded section formed at a certain portion of its other side for engaging with a male-threaded section of an adjustment valve. The adjustment valve is provided with a fuel entering passage formed axially with a dead end, and an injection nozzle formed at the end corresponding to and for a needle valve of the second needle to move to and fro therein. And, the adjustment valve is directly installed in the axial hole without being accompanied with other components, effective to lower progressive tolerance between the injection nozzle and the needle valve to provide uniform fuel injection.

BRIEF DESCRIPTION OF DRAWINGS

This invention is better understood by referring to the accompanying drawings, wherein.

DETAILED DESCRIPTION OF THE PREFERRED EMBODIMENT

Figure 1:
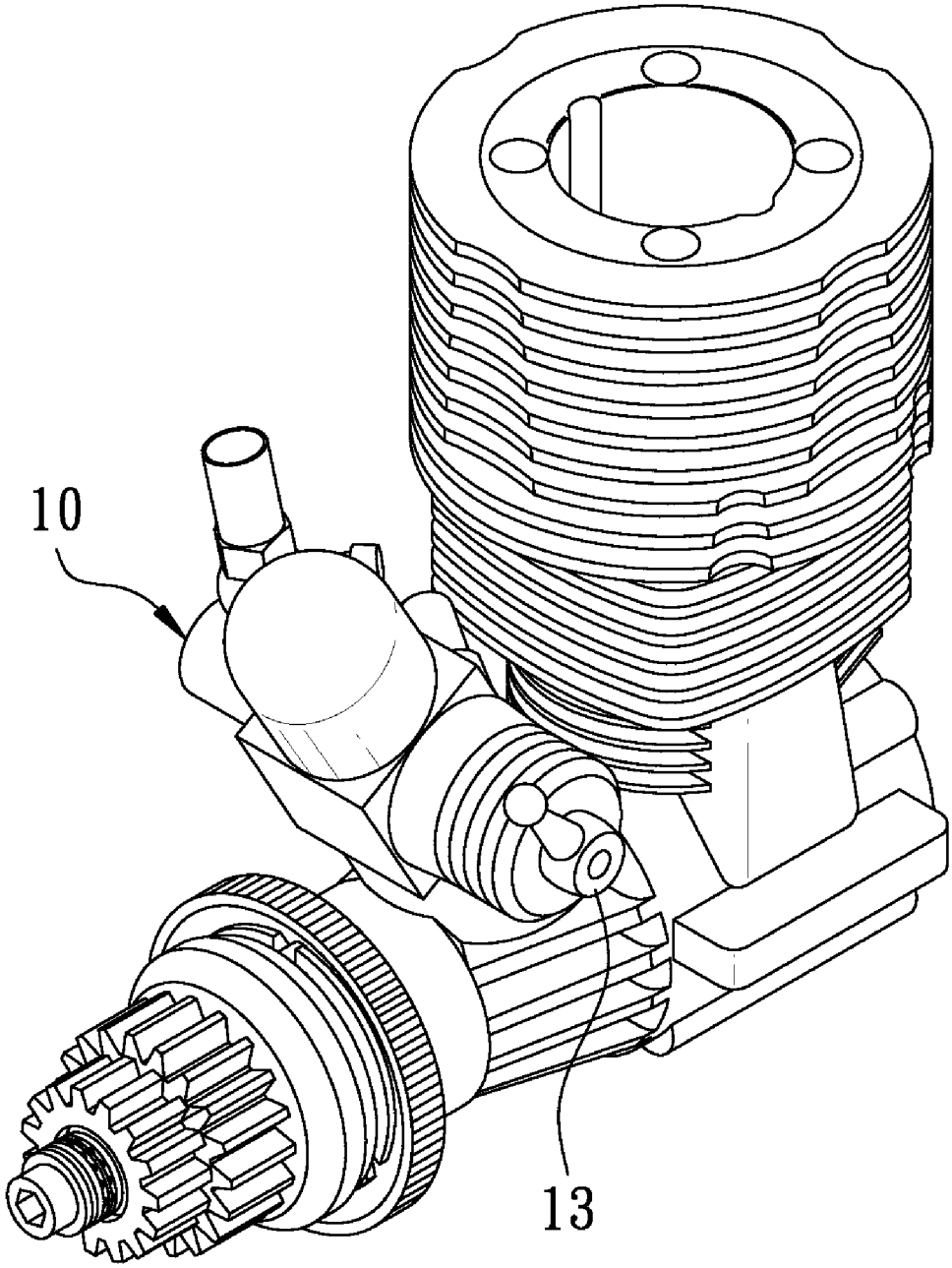
FIG. 1 PRIOR ART
FIG. 1 is a perspective view of a conventional carburetor of a remote control model.
Figure 2:
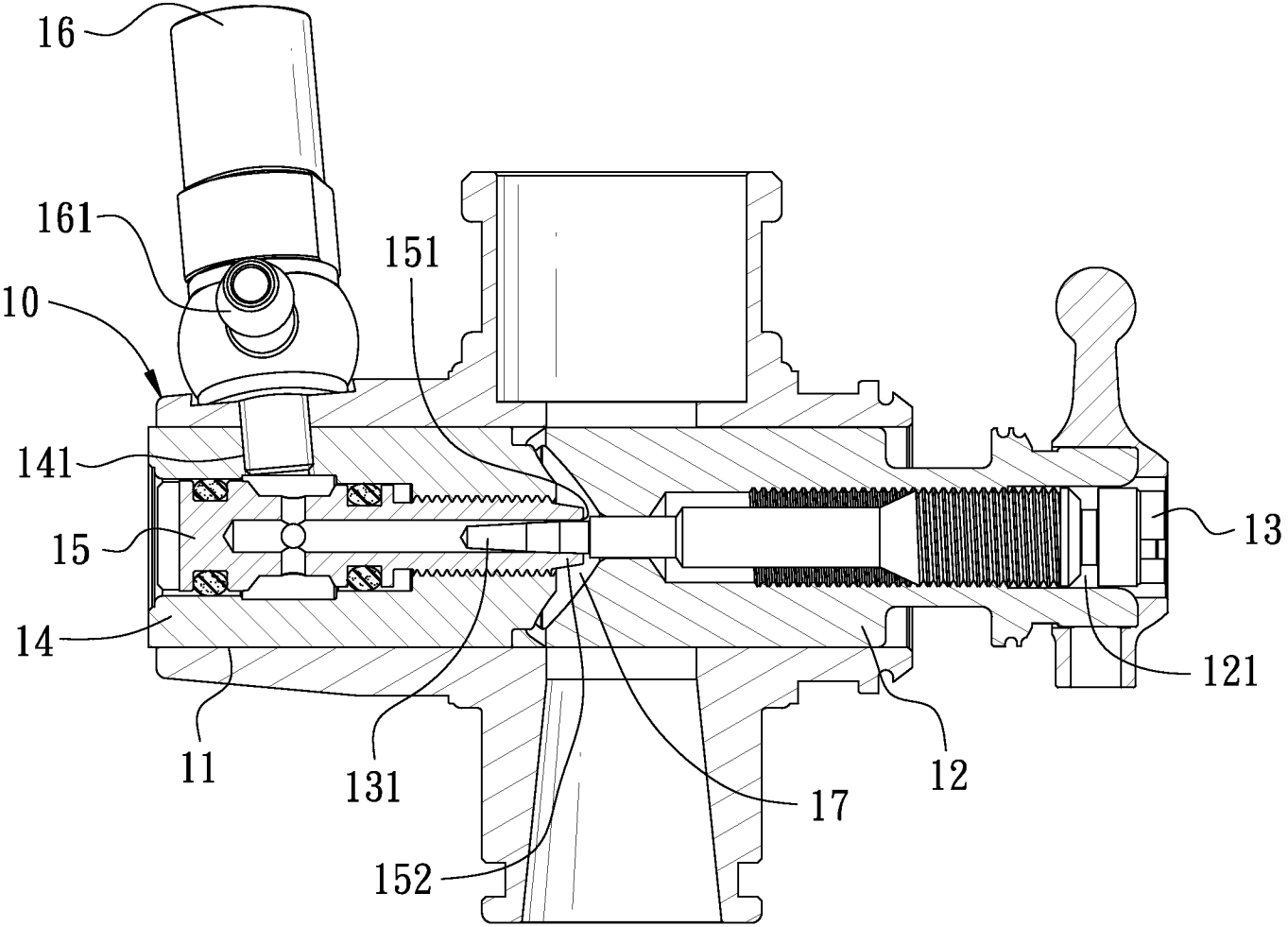
FIG. 2 PRIOR ART
FIG. 2 is a longitudinal cross-sectional view of the conventional carburetor of a remote control model.
Figure 3:
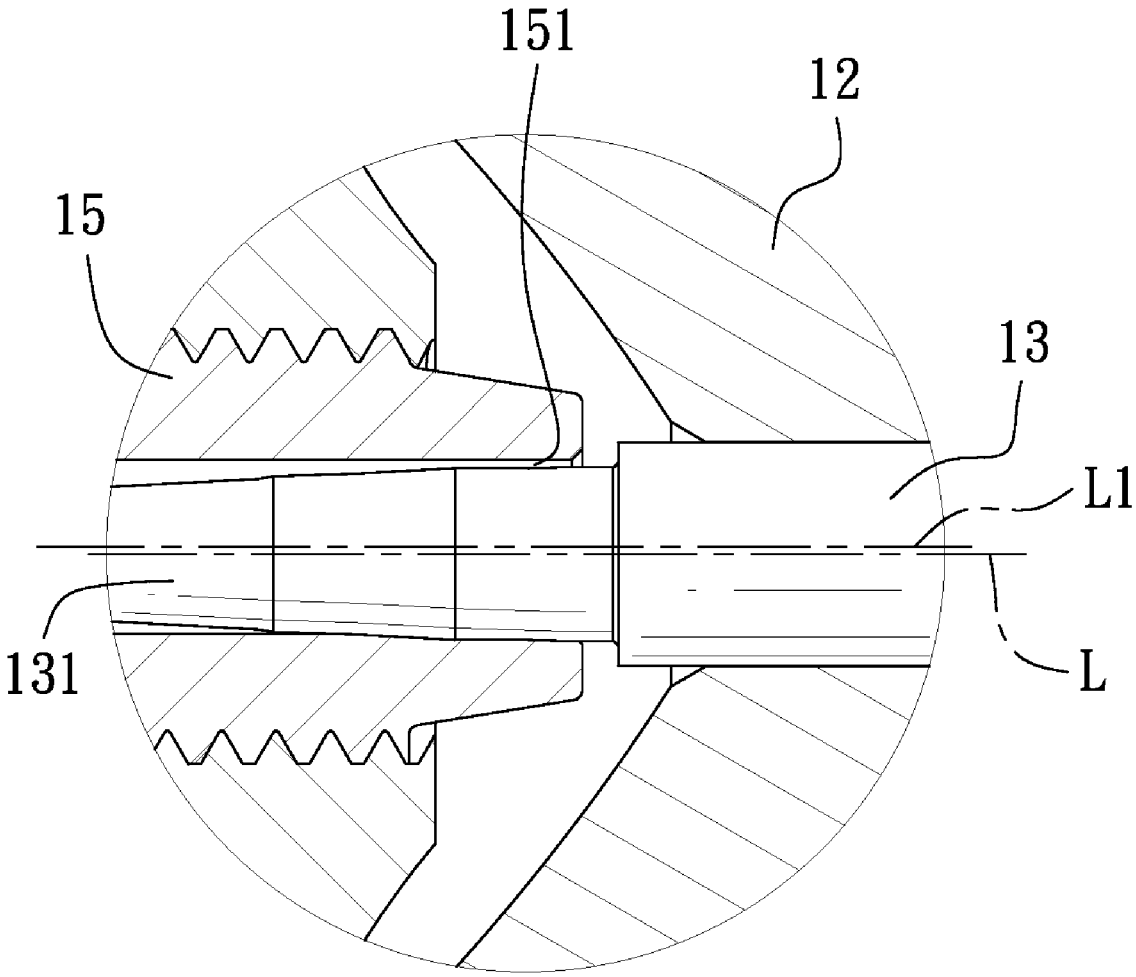
FIG. 3 PRIOR ART
FIG. 3 is a partial magnified cross-sectional view of the conventional carburetor of a remote control model.
Figure 4:
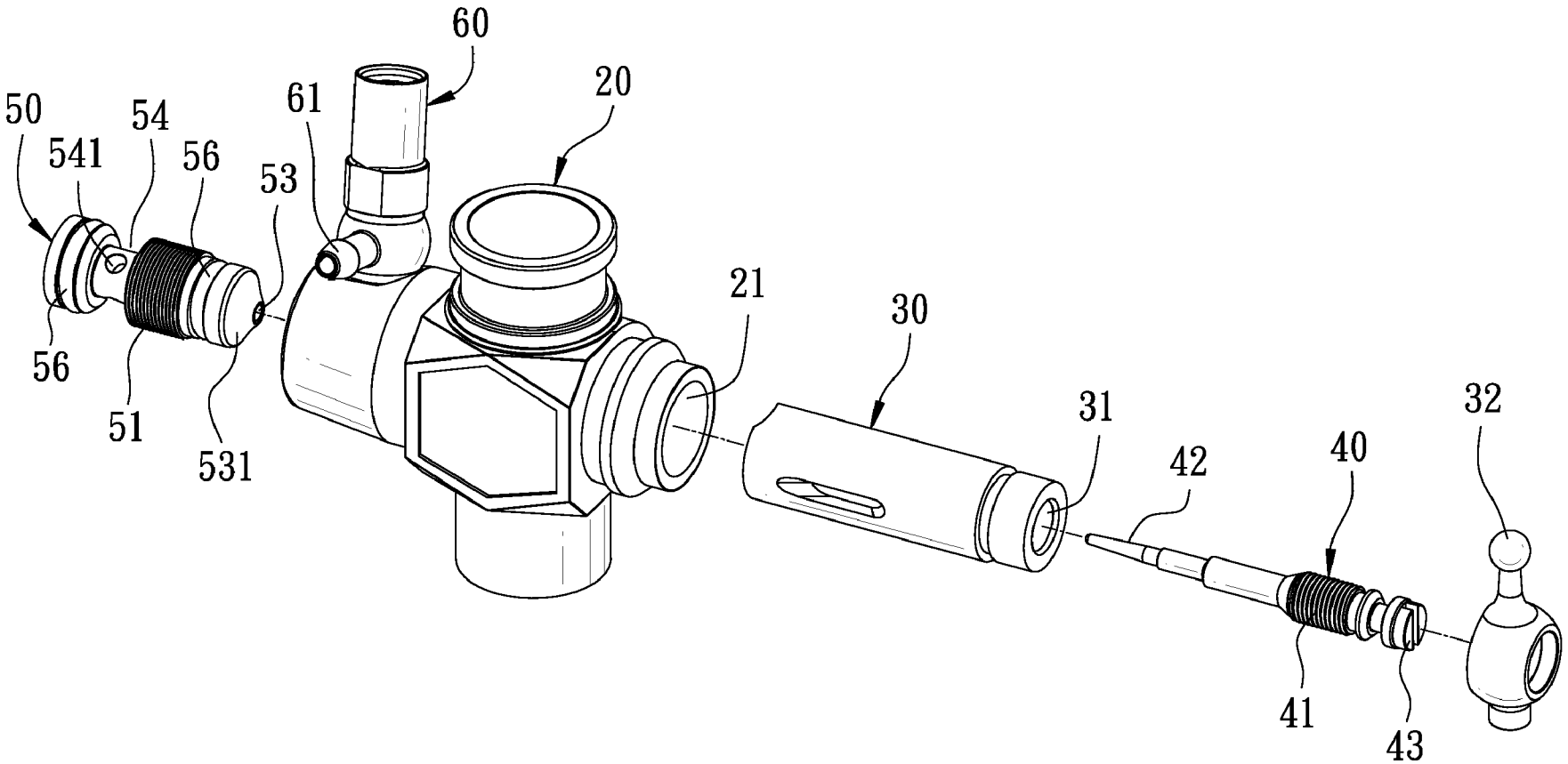
FIG. 4 is an exploded perspective view of a preferred embodiment of a carburetor of a remote control model in the present invention.
Figure 5:
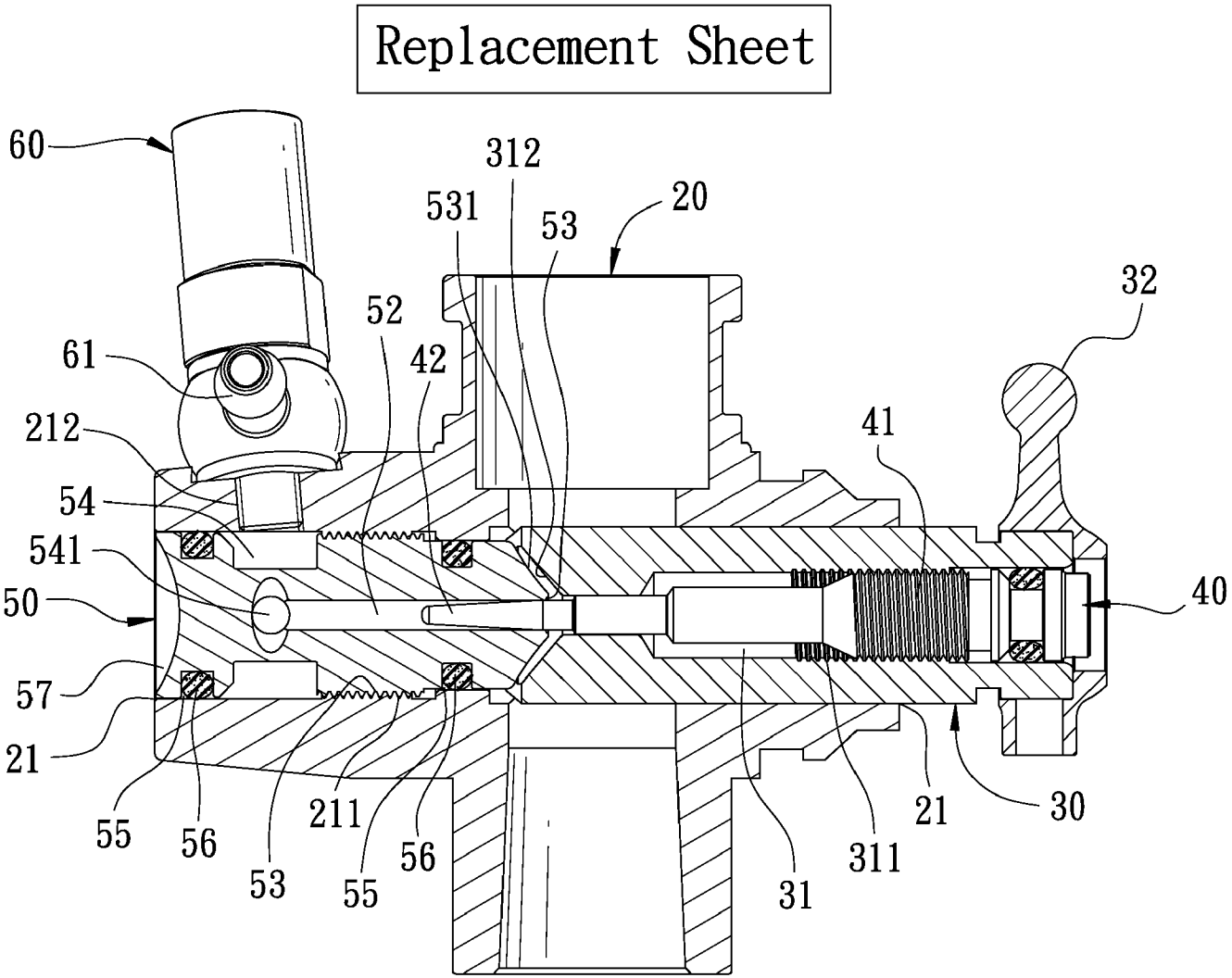
FIG. 5 is a longitudinal cross-sectional view of the preferred embodiment of a carburetor of a remote control model in the present invention.

As shown in FIGS. 4 and 5, a preferred embodiment of a carburetor of a remote control model in the present invention is composed of a main body 20, a throttle 30, a second needle 40, an adjustment valve 50 and a main needle 60.

The main body 20 is bored axially with an axial hole 21.

The throttle 30 is installed movable axially in one side of the main body 20 to be therein, provided with a throttle hole 31 bored axially. The throttle hole 31 is provided with a female-threaded section 311 formed around its outside portion, and a concave conical surface 312 formed at its one end inside the axial hole 21. The throttle 30 is combined with an operating bar 32, which is fixed around an outer end of the throttle 30.

The second needle 40 is provided with a male-threaded section 41 formed near its outer end for engaging with the female-threaded section 311 of the throttle hole 31, a needle valve 42 formed by tapering at its inner side in the axial hole 21, and an operating portion 43 formed at its outer end.

The adjustment valve 50 is provided with a male-threaded section 51 formed around its intermediate portion for engaging with a female-threaded section 211 formed around the intermediate portion of the axial hole 21. The adjustment valve 50 is also provided with a fuel entering passage 52 formed axially with a dead end, a injection nozzle 53 formed at the other end of the fuel entering passage 52 to correspond with the needle valve 42, and a convex conical surface 531 formed around the injection nozzle 53 to face to the concave conical surface 312. The injection nozzle 53 is located at the center of the convex conical surface 312 for being inserted with the needle valve 42. Slightly inward the end of the adjustment valve 50, opposite to the injection nozzle 53, is formed with an annular groove 54, which is symmetrically bored with four holes 541 spaced apart equidistantly for communicating with the fuel entering passage 52. A threaded hole 212 is bored vertically on the main body 20 through the axial hole 21, for corresponding to the annular groove 54. Further, there is an annular groove 55 cut around slightly inward two ends of the adjustment valve 50 respectively, for being fitted with a sealing element 56. In addition, the adjustment valve 50 is provided with an operating portion 57 formed concave at its other end opposite to the injection nozzle 53. The annular grooves 55 are tightly sealed with the O-shaped sealing elements 56 to prevent fuel from leaking out.

The main fuel needle 60 is fixedly engaged with the threaded hole 212, provided with a fuel inlet nozzle 61 positioned aside for connecting with a fuel hose to a fuel tank (not shown in Figures), so as to supply fuel to enter the annular groove 54 and then, through the holes 541 to the fuel entering passage 52

Figure 6:
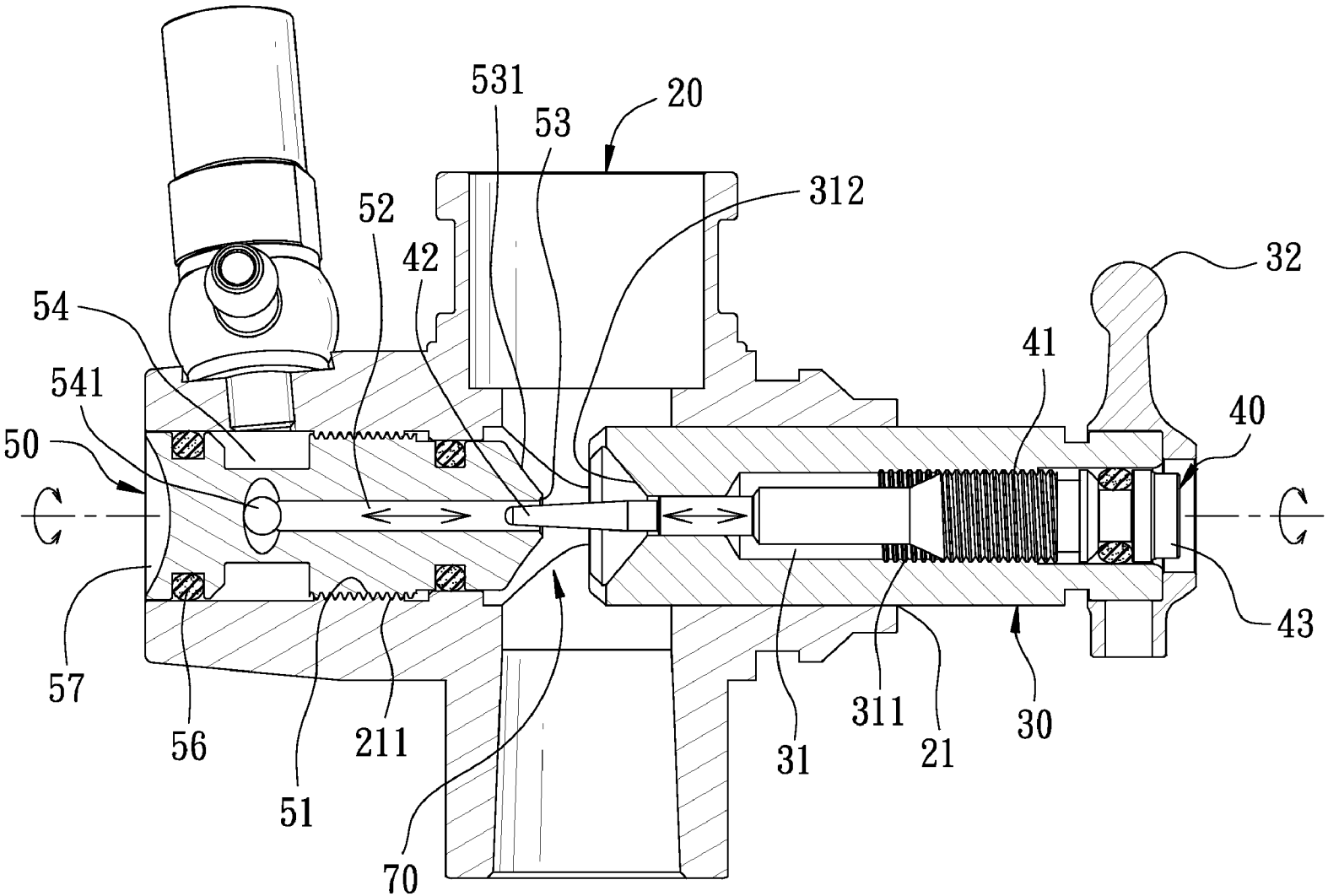
FIG. 6 is a longitudinal cross-sectional view of the preferred embodiment of a carburetor of a remote control model in the present invention, showing it being operated.

In using, as shown in FIG. 6, when the carburetor is to be adjusted, the operating portion 43 of the second needle 40 and the operating portion 57 of the adjustment valve 50 are respectively rotated to move axially to adjust the gap between the injection nozzle 53 and the needle valve 42, for controlling fuel injection amount. At the same time, a mixing chamber 70 formed between the convex conical surface 531 of the adjustment valve 50 and the concave conical surface 312 is enlarged to provide a bigger room to mix fuel with air.

Figure 7:
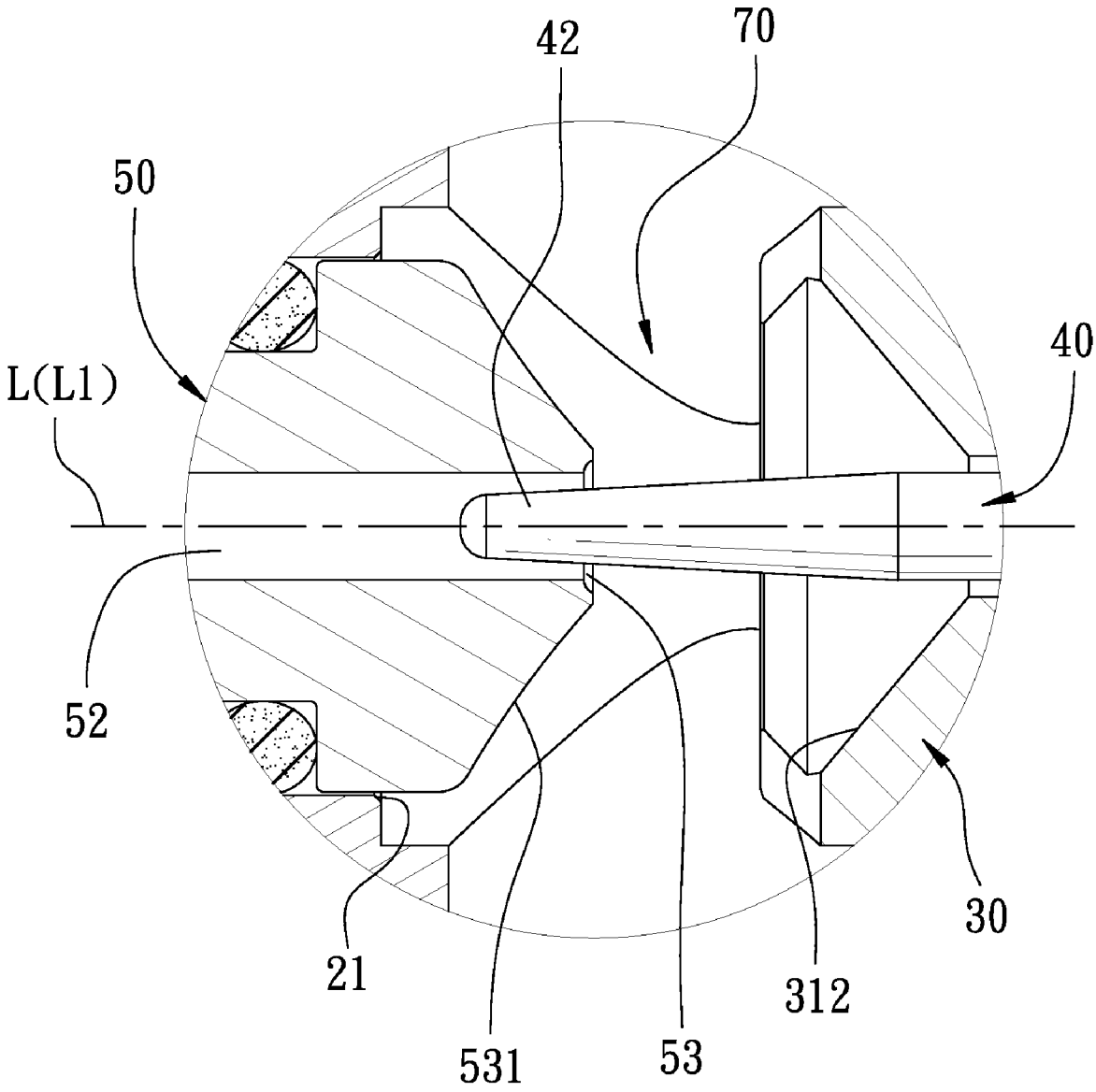
FIG. 7 is a partial magnified cross-sectional view of the preferred embodiment of a carburetor of a remote control model in the present invention.

Moreover, as shown in FIG. 7, the adjustment valve 50 is directly engaged with the axial hole 21, unnecessary to be extra installed with a guiding sleeve as the conventional one is, able to lower progressive tolerance created while assembling. That is, the center lines L and L1 between the second needle 40 and the adjustment valve 50 are comparatively unable to be deviated, so as to keep the gap between the needle valve 42 and the injection nozzle 53 spaced uniformly to provide an even fuel injection.

The advantages of the invention are described below as can be seen from the foresaid description.

As the adjustment valve 50 is directly engaged with the axial hole 21 without being installed with any extra component, it is helpful to lessen progressive tolerance created while assembling, so as to keep the gap between the needle valve 42 and the injection nozzle 53 spaced uniformly to provide an even fuel injection. And, the mixing chamber 70 formed between the convex conical surface 531 of the adjustment valve 50 and the concave conical surface 312 is enlarged to provide a bigger space to mix fuel with air.

While the preferred embodiment of the invention has been described above, it will be recognized and understood that various modifications may be made therein and the appended claims are intended to cover all such modifications that may fall within the spirit and scope of the invention.

What is claimed is:

1. A carburetor of a remote control model comprising a main body that is bored throughout with an axial hole axially, a throttle installed in one side of said main body to be movable axially therein and having a throttle hole bored axially, and a second needle engaged with said throttle hole and provided with a needle valve formed by tapering at its one side in said axial hole, said carburetor characterized by:

said axial hole provided with a female-threaded section formed around its intermediate portion for engaging with a male-threaded section formed around an intermediate portion of an adjustment valve, said adjustment valve provided with a fuel entering passage formed axially with a dead end and an injection nozzle formed at another end of said fuel entering passage to correspondingly let said needle valve move in said fuel entering passage to and from, an annular groove formed around slightly inward one end of said adjustment valve for being opposite to said injection nozzle and bored with one hole for communicating with said fuel entering passage, a threaded hole bored vertically on said main body through said axial hole to correspond to said annular groove for being engaged with a main needle that is provided with a fuel inlet nozzle positioned aside to supply fuel.

2. The carburetor of a remote control model as claimed in claim 1, wherein said adjustment valve is provided with an annular groove cut around slightly inward its two ends respectively and fitted with a sealing element.

3. The carburetor of a remote control model as claimed in claim 2, wherein said sealing element is an O-shaped ring.

4. The carburetor of a remote control model as claimed in claim 1, wherein said annular groove of said adjustment valve is symmetrically bored with four said holes spaced apart equidistantly for communicating with said fuel entering passage.

5. The carburetor of a remote control model as claimed in claim 1, wherein said adjustment valve is provided with a convex conical surface to correspond to a concave conical surface provided in said throttle to form a mixing chamber, said injection nozzle located at a center of said convex conical surface and movably inserted with said needle valve of said second needle.

6. The carburetor of a remote control model as claimed in claim 1, wherein said adjustment valve is provided with an operating portion formed at an end opposite to said injection nozzle and having a concave shape.

* * * * *